US011858766B2

(12) United States Patent
Rod et al.

(10) Patent No.: US 11,858,766 B2
(45) Date of Patent: Jan. 2, 2024

(54) DEVICE AND METHOD FOR CHANGING A SHEET PILE IN A SHEET FEEDER

(71) Applicant: BOBST MEX SA, Mex (CH)

(72) Inventors: Michel Rod, Semsales (CH); Jeremy Cordelier, Puidoux (CH)

(73) Assignee: BOBST MEX SA, Mex (CH)

( * ) Notice: Subject to any disclaimer, the term of this patent is extended or adjusted under 35 U.S.C. 154(b) by 234 days.

(21) Appl. No.: 17/424,470

(22) PCT Filed: Jan. 31, 2020

(86) PCT No.: PCT/EP2020/025043
§ 371 (c)(1),
(2) Date: Jul. 20, 2021

(87) PCT Pub. No.: WO2020/164802
PCT Pub. Date: Aug. 20, 2020

(65) Prior Publication Data

US 2022/0089389 A1 Mar. 24, 2022

(30) Foreign Application Priority Data

Feb. 11, 2019 (EP) ..... 19020062

(51) Int. Cl.
*B65H 1/26* (2006.01)
*B65H 1/14* (2006.01)

(52) U.S. Cl.
CPC ..... *B65H 1/263* (2013.01); *B65H 1/14* (2013.01); *B65H 2301/42256* (2013.01);
(Continued)

(58) Field of Classification Search
CPC ..... B65H 1/263; B65H 1/14; B65H 2301/42256; B65H 2403/51;
(Continued)

(56) References Cited

U.S. PATENT DOCUMENTS 5,669,755 A 9/1997 Zahn
6,209,863 B1 * 4/2001 Hummel ..... B65H 1/263 271/157
(Continued)

FOREIGN PATENT DOCUMENTS

CN 1118593 A 3/1996
CN 1323691 A 11/2001
(Continued)

OTHER PUBLICATIONS

International Search Report dated Apr. 8, 2020 in counterpart International Patent Application No. PCT/EP2020/025043 (2 pages, in English).

*Primary Examiner* — Lynn E Schwenning
(74) *Attorney, Agent, or Firm* — Bookoff McAndrews PLLC

(57) ABSTRACT

A device (12) for changing a sheet pile in a sheet feeder (10) for a sheet treating machine is described. The device (12) comprises a main pile supporting unit (18) having a supporting surface (22) adapted to support a pallet (16) carrying a sheet pile. Furthermore, the device (12) comprises a residual pile supporting unit (24) with a plurality of residual pile bars (28), which can be moved into a sheet pile region (30) when the sheet pile is to be changed. The residual pile bars (28) are then carrying the sheet pile. When in the sheet pile region (30), each of the residual pile bars (28) is movable in a direction substantially orthogonal to the supporting surface (22), wherein the residual pile bars (28) are movable independently from each other. Furthermore, a method for changing the sheet pile in a sheet feeder (10) for a sheet treating machine is explained.

20 Claims, 12 Drawing Sheets

Figure 1:
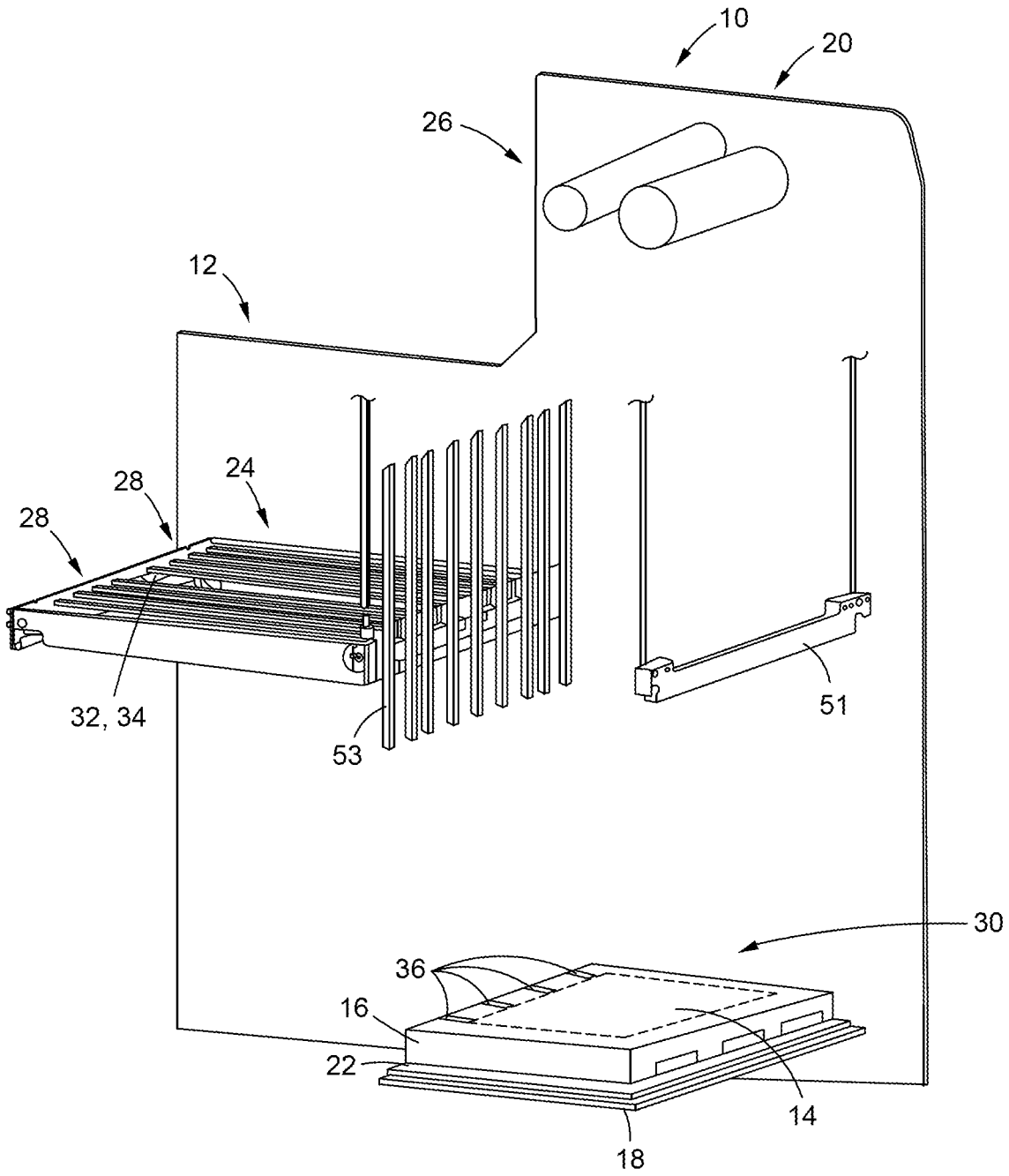

(52) U.S. Cl.
CPC .. *B65H 2403/51* (2013.01); *B65H 2405/3231* (2013.01); *B65H 2801/21* (2013.01); *B65H 2801/42* (2013.01)

(58) Field of Classification Search
CPC ..... B65H 2405/3231; B65H 31/32; B65H 2301/4212; B65H 2405/323; B65H 2553/43; B65H 2553/52; B65H 2557/13; B65H 2701/1764; B31B 50/98
See application file for complete search history.

(56) References Cited

U.S. PATENT DOCUMENTS

| | | | |
|---|---|---|---|
| 6,676,364 | B1 | 1/2004 | Hummel et al. |
| 2001/0053393 | A1 | 12/2001 | Baumann et al. |

FOREIGN PATENT DOCUMENTS

| | | | |
|---|---|---|---|
| CN | 104334483 | A | 2/2015 |
| CN | 104797515 | A | 7/2015 |
| CN | 107628467 | A | 1/2018 |
| DE | 102010062285 | A1 | 6/2012 |
| EP | 0958215 | B1 | 10/2001 |
| EP | 2149522 | A2 | 2/2010 |
| EP | 2834178 | B1 | 5/2016 |
| JP | 49-116530 | S | 9/1974 |
| JP | 08-067358 | A | 3/1996 |
| JP | 2000-509695 | A | 8/2000 |
| TW | 512121 | B | 12/2002 |
| TW | M308944 | U | 4/2007 |
| TW | 201619034 | A | 6/2016 |

* cited by examiner

DEVICE AND METHOD FOR CHANGING A SHEET PILE IN A SHEET FEEDER

CROSS-REFERENCE TO RELATED APPLICATION(S)

This application is a National Stage under 35 U.S.C. § 371 of International Application No. PCT/EP2020/025043, filed Jan. 31, 2020, which claims priority to European Patent Application No. 19020062.6, filed on Feb. 11, 2019, the contents of all of which are incorporated by reference in their entirety.

The invention refers to a device for changing a sheet pile in a sheet feeder for a sheet treating machine, comprising a main pile supporting unit with a main pile actuating unit for lifting and lowering the main pile supporting unit, wherein the main pile supporting unit comprises a supporting surface adapted to support a pallet carrying a sheet pile, further comprising a residual pile supporting unit with a residual pile actuating unit for lifting and lowering the residual pile supporting unit, wherein the residual pile supporting unit comprises a plurality of residual pile bars extending substantially parallel to each other and being substantially parallel to the supporting surface, wherein the residual pile bars are coupled to a bar actuating unit adapted to move the residual pile bars into a sheet pile region and retract the residual pile bars from the sheet pile region, wherein the residual pile bars are arranged in the residual pile supporting unit in a rake-like manner such that they can be positioned in respective slots of a pallet being supported on the main pile supporting unit when the residual pile bars are in the sheet pile region.

Sheet treating machines in the sense of the present patent application are for example sheet cutting machines or sheet printing machines. Of course, other types of sheet treating machines are also addressed by the present invention.

In general, sheet treating machines can be adapted to any kind of sheet material. Examples thereof are paper, cardboard, plastics, metal, composite materials, and leather.

The rake-like arrangement of the residual pile bars means that a plurality of residual pile bars extends in a substantially parallel manner from a common basis. Thereby, one end of each residual pile bar is connected to this common basis, wherein a respective opposite end freely protrudes therefrom. Other words designating this arrangement are "fork-like" or "grid". In the present patent application, these terms are seen as synonyms.

Additionally, the invention refers to a method for changing a sheet pile in a sheet feeder for a sheet treating machine, comprising the following steps:

(a) detecting a limit height of a sheet pile being processed in the sheet feeder, wherein the sheet pile is supported on a pallet being arranged on a main pile supporting unit, (b) supporting the sheet pile by a residual pile supporting unit in that a plurality of residual pile bars are pushed into respective slots of the pallet, (c) withdrawing the pallet being arranged on the main pile supporting unit from the sheet pile and placing a replacement pallet carrying a replacement sheet pile on the main pile supporting unit, (d) bringing an upper end of the replacement sheet pile in contact with the residual pile bars such that the residual pile bars are engaged between a lower end of the sheet pile and an upper end of the replacement sheet pile, (e) retracting the residual pile bars from a pile region such that the sheet pile is supported on the replacement sheet pile.

Such devices and methods are known in the art. For example EP 0 958 215 B1 discloses a device as described above, which can be used to carry out a method as described above.

In known devices for changing a sheet pile in a sheet feeder the movement of the main pile supporting unit usually is synchronized to the sheets being taken from the pile. This means that the main pile supporting unit is raised by a distance corresponding to a thickness of a sheet each time a sheet is taken from the sheet pile. In alternative solutions, the supporting unit is raised by a distance corresponding to a cumulated thickness of a certain number of sheets after this number of sheets has been taken from the sheet pile. Additionally, the residual pile supporting unit is usually synchronized to the main pile supporting unit when residual pile bars are pushed into the slots of a pallet being positioned on the main pile supporting unit. In a situation when the sheet pile is only supported by the residual pile bars, they are synchronized to the sheets being taken from the sheet pile in the same way the main pile supporting unit is synchronizes thereto (cf. above). As a result, such a device for changing a sheet pile in a sheet feeder allows to change a sheet pile, more precisely a sheet pile being positioned on a corresponding pallet, without having to interrupt the flow of sheets being fed from the sheet feeder to a sheet treating machine. Consequently, the sheet treating machine can be operated non-stop.

It has always been a challenge in the fields of sheet feeders to find a good compromise between high operational speeds and a secure and gentle handling of sensitive sheets. In other words, high operational speeds are limited by the requirement of not causing any damage or detriment to the sheets of the sheet pile being processed in the sheet feeder.

It is therefore an object of the present invention to eliminate or at least reduced the conflict of objectives mentioned above. An improved device for changing a sheet pile in a sheet feeder shall be provided, which is able to feed sheets at high operational speeds without risking to damage these sheets.

The problem is solved by a device according to the preamble of claim 1, wherein each of the residual pile bars is movable within a predefined range of movement in a direction substantially orthogonal to the supporting surface, and wherein the residual pile bars are movable independently from each other. The invention is based on the finding that the situation when the residual pile bars are retracted from the sheet pile region is crucial for combining high operational speed and gentle sheet handling. Put otherwise, the conflict of objects mentioned above can only be reduced or eliminated when this conflict of objects is solved for the situation when the residual pile bars are retracted from the sheet pile region. As in this situation, the residual pile bars are engaged between an upper end of a replacement pile and a lower end of a residual pile currently being processed, they need to be retracted in a way that neither the residual pile nor the replacement pile experiences any damage or detriment. As the supporting surface generally is a horizontal surface, i. e. a surface with a vertical surface normal, the movement to bring the residual pile bars into the sheet pile region is generally a horizontal movement. Also the movement of retracting the residual pile bars is generally horizontal. It results therefrom that the residual pile bars of the inventive device have a generally vertical degree of freedom. The fact that the residual pile bars are movable independently from each other is linked to this vertical degree of freedom. This vertical degree of freedom or the range of movement is the reason why the residual pile bars can adapt their vertical position to the position of the bottom of a residual pile and/or the top of a replacement pile. This is true for individual residual pile bars and for groups thereof. Therefore, the vertical forces acting on the residual pile bars are reduced to a minimum. In an idealized case, the residual pile bars are only charged by the weight of the residual pile being positioned on top of the residual pile bars. This results in a minimum of friction forces between the residual pile bars and the sheets of the residual pile as well as the replacement pile. Consequently, when the residual pile bars are retracted from the sheet pile region, a minimum resistance has to be overcome. This means that the risk to damage the sheets being in contact with the residual pile bars is also minimized. Thus, the device according to the invention is especially suitable for treating very delicate sheets at high operational speeds. The effects and advantages mentioned above are especially important if the upper surface of the replacement pile or the lower surface of the residual pile is not perfectly even but includes wavy portions for example. Then the residual pile bars can adapt their position to this wavy geometry.

The effects and advantages mentioned before also apply to devices for changing a sheet pile in a sheet feeder for a sheet treating machine, in which a sensor is used to detect the situation that the replacement pile has reached its operational state. In an exemplary device, this is detected by monitoring the lifting of the residual pile bars resulting from the replacement pile making contact with the residual pile bars. Once the replacement pile is operational, the residual pile bars can be retracted from the sheet pile region. The device according to the invention is also advantageous in this case since the sensor signal may be subject to impreciseness in the time range. Consequently, the process of retracting the residual pile bars may be started too late. In a device according to the invention, this imperfection is compensated by the vertical movability of the residual pile bars and does not lead to additional forces thereon. The same is true in case of a sensor error.

In a preferred embodiment, the residual pile bars are only movable in the direction substantially orthogonal to the supporting surface while they are located in the sheet pile region and while they are being retracted form the sheet pile region. In other words, the vertical movability according to the invention is only provided in this situation. In all other situations, this kind of movability is blocked.

The predefined range of movement is preferably 15 mm to 150 mm, especially 20 mm to 120 mm. The range of movement can be adapted according to the specific conditions under which the device is used. The range of movement can for example be 40 mm, 70 mm or 100 mm.

The bar actuating unit can be an electric, pneumatic or hydraulic bar actuating unit. In a preferred example, it is a linear electric drive.

According to a preferred embodiment a lowest position and a highest position is attributed to each of the residual pile bars, wherein the device for changing a sheet pile comprises a locking unit adapted to lock all of the residual pile bars in the lowest position. As a result thereof, the residual pile bars are vertically not movable in the locked condition, whereas the movability is to be assessed relative to the residual pile actuating unit. Of course, the residual pile actuating unit is still movable in a vertical direction and therefore the residual pile bars are movable together with the residual pile actuating unit. Consequently, in the locked condition, the residual pile bars can be positioned very precisely in a vertical direction. This is important when the residual pile bars are to be moved into the sheet pile region and especially into respective slots of a pallet being supported on the main pile supporting unit.

The locking unit preferably comprises an electric, hydraulic or pneumatic locking drive.

The bar actuating unit can comprise a first supporting bar extending in a substantially orthogonal direction with respect to the residual pile bars and being substantially parallel to the supporting surface, wherein respective first end sections of each of the residual pile bars are coupled to the first supporting bar. Preferably, the first supporting bar is movable by a first supporting bar actuating unit. Thus, by moving the first supporting bar, also the residual pile bars are moved. Consequently, the residual pile bars can be moved into the sheet pile region by moving the first supporting bar correspondingly. In the same way, the residual pile bars can be retracted from the sheet pile region. As all residual pile bars are coupled to the first supporting bar, the residual pile bars can only be moved together. Such a design is simple in structure and therefore easy to mount and to maintain. Also the costs of production are low.

Preferably, each of the residual pile bars comprises a guide rod being connected to the respective first end section, wherein the guide rod is guided inside a corresponding guide opening, wherein the guide openings are arranged on the first supporting bar and wherein the guide rods and the guide openings extend substantially orthogonal to the supporting surface. In other words, the guide rods and the guide openings extend substantially in a vertical direction. In this context, the broadest possible meaning is to be attributed to the term guide rod. Such a guide rod can for example be a guide bar or a guide tube. The system of guide rods and guide openings allows for the vertical movability of each of the residual pile bars, which has already been explained above. It represents a reliable and efficient way to do so and to exclude all other degrees of freedom.

Preferably, each of the residual pile bars is closer to the first supporting bar when in the lowest position than in the highest position. In such an embodiment the first supporting bar can also represent a lower end stop against which the residual pile bar abuts, when in the lowest position.

In an alternative embodiment, the guide rod comprises a slot on its outer circumference, which interacts with a pin connected to the first supporting bar. The pin is able to move relative to the slot between two end positions being arranged opposite each other. Of course this system of pin and slot can also be cinematically inversed. In this way, the predefined range of movement of the residual pile bars can be implemented in an easy and reliable manner.

Advantageously, the locking unit comprises a locking profile movable into a locking position and an unlocking position, wherein the locking profile is slidably supported on the first supporting bar and extends substantially parallel to the first supporting bar. In the locking position a locking portion of the locking profile is positioned on top of the residual pile bars such that a vertical movement of the residual pile bars is blocked. As mentioned above, the residual pile bars are preferably locked when in their lowest position. In the unlocking position, the locking portions are out of engagement with the residual pile bars such that they are free to move in a vertical direction.

The locking profile can be made from sheet metal and is preferably supported on a guide rail.

According to a preferred embodiment, each of the guide rods is slightly tilted with respect to the respective guide opening when the corresponding residual pile bar is in the highest position and in the sheet pile region, such that the guide rod is canted inside the respective guide opening. Consequently, the residual pile bars are locked in the highest position. This locking mechanism can be designed as a self-locking mechanism. In this case, each residual pile bar and the guide rod connected thereto form a residual pile bar assembly and a center of gravity of each of the residual pile bar assembly is spaced from the respective guide rod. Consequently, as an effect of gravity the residual pile bar assembly will be tilted with respect to the corresponding guide opening and therefore cause the guide rod to be canted therein.

The device for changing a sheet pile preferably comprises an unlocking means being adapted to bring one or more of the guide rods into a non-tilted position with respect to the respective guide opening or guide openings. In the non-tilted position, the guide rod is not canted any more inside the corresponding guide opening. In this position, the guide rod is freely movable inside the guide opening. Examples of such an unlocking means are an unlocking lever and an unlocking profile. Both are pivoted against one or more residual pile bars to be unlocked and thereby move the residual pile bars into the non-tilted position.

In order to allow for a smooth transition of the residual pile bars from a highest position to a lowest position, shock absorbers can be allocated to each of the residual pile bars. They can make sure that the residual pile bars reach the lowest position in a smooth and consistent movement. The shock absorbers can be arranged on the first supporting bar, the guide rod or the residual pile bar.

In an alternative, the bar actuating unit comprises a plurality of residual pile bar actuating units, wherein each of the residual pile bars is coupled to one single residual pile bar actuating units such that the residual pile bars are adapted to being moved into a sheet pile region independently from each other and/or being retracted from the sheet pile region independently from each other. Of course, also in this embodiment, the residual pile bars are independent from each other with respect to the predefined range of movement in the direction substantially orthogonal to the supporting surface. Consequently, it is possible to retract the residual pile bars from the sheet pile region one-by-one or in freely definable groups. The same is true for moving the residual pile bars into the sheet pile region.

In an especially preferred embodiment, the residual pile bars are moved into the sheet pile region in a coupled, dependent manner, i.e. all residual pile bars are moved into the sheet pile region together, but are retracted therefrom independent from each other.

Examples for residual pile bar actuating units include linear axles, linear electric drives, pneumatic drives, and hydraulic drives.

According to a variant, each of the residual pile bar actuating units comprises a slider carriage, wherein the corresponding residual pile bar is coupled to the slider carriage. In this embodiment, each slider carriage is a means to couple the corresponding residual pile bar to the corresponding residual pile bar actuating unit. The slider carriage accounts for a precise movement in the horizontal direction. Furthermore, it guarantees a reliable coupling of the residual pile bar to the corresponding residual pile bar actuating unit.

Preferably, each slider carriage is coupled to the corresponding residual pile bar via a cam mechanism. In this context, the cam mechanism is to be understood in the most general sense. A cam of such a cam mechanism can comprise an external cam surface of an internal cam surface, i.e. the cam surface can be provided on any kind of protrusion or as a boundary surface of a recess or opening. The cam mechanism is designed such that it allows for the predefined range of movement in a direction substantially orthogonal to the supporting surface. Additionally, the cam mechanism is adapted to transfer the forces and/or torques necessary to move the residual pile bars into the sheet pile region and to retract them therefrom.

In this case, the locking unit can comprise a locking recess being part of each of the cam mechanisms. Thus, in the locked state, a counterpart element of the cam mechanism is located in the locking recess and blocks a movement of the corresponding residual pile bar in the vertical direction. Once the counterpart element has left the locking recess, the corresponding residual pile bar is movable within the predefined range of movement.

In a further embodiment, end sections of the residual pile bars facing away from the bar actuating unit are supported on a second supporting bar when the residual pile bars are in the sheet pile region. In this case, the second supporting bar may be arranged substantially parallel to a first supporting bar and/or substantially orthogonal to the residual pile bars. Consequently, the residual pile bars are held in a well-defined and stable position, when in the sheet pile region.

The second supporting bar may be equipped with a sensor, which is able to detect the presence of the ends of the residual pile bars being supported on the second supporting bar. The same sensor or an additional one may be adapted to detect the presence of a replacement sheet pile under the residual pile bars by detecting a raise of the residual pile bars once contact is made with top end of the replacement sheet pile. Subsequently, the retraction of the residual pile bars may be started.

In an additional embodiment, the residual pile bars may be coupled to a horizontal positioning unit. With the horizontal positioning unit, the residual pile bars may be moved in a direction orthogonal to the general extension of the residual pile bars. Thereby, the relative position between the residual pile bars and corresponding slots of a pallet can be adapted. It is therefore guaranteed to be able to position the residual pile bars into the corresponding slots in a well-defined manner.

Additionally, the problem is solved by a method as described above for changing a sheet pile in a sheet feeder for a sheet treating machine, comprising the following step: retracting the residual pile bars from a pile region such that the sheet pile is supported on the replacement sheet pile, wherein the residual pile bars are freely movable in a direction orthogonal to a pallet surface while being retracted. The effects and advantages mentioned in respect of the device for changing a sheet pile in a sheet feeder for a sheet treating machine apply mutandis mutandis for this method.

Preferably, all of the residual pile bars are locked in a lowest position during steps b) to c). Consequently, the residual pile bars can be precisely positioned in the corresponding slots of the pallet.

During or after step d) the residual pile bars can be unlocked and during step d) and/or e) one or more of the residual pile bars can be moved out of the lowest position. Reference is made to the effects and advantages mentioned above.

In an embodiment a contact between the upper end of the replacement sheet pile and the residual pile bars is detected for each of the residual pile bars individually during step d). To this end, one sensor may be attributed to each residual pile bar. As explained above, such a sensor may be adapted to detect the raise of the corresponding residual pile bar which results from making contact with a replacement sheet pile. Subsequently, the residual pile bars may be retracted from the sheet pile region.

During step e), the residual pile bars can be retracted independently from each other. The residual pile bars can be retracted individually, i.e. one-by-one, or in freely definable groups. The retraction movement of individual bars may overlap time-wise, i.e. more than one residual pile bars may be moved at the same time. For example one residual pile bar may be close to the end of the retraction movement while a different residual pile bar just starts being retracted. It is preferred that not all residual pile bars are retracted at the same time.

Advantageously, all of the residual pile bars are moved to their respective lowest position after step e). This movement may be powered by gravity only. Additionally, they may be locked in the lowest position.

In the following, embodiments of the invention will be explained with reference to the attached figures.

Figure 2:
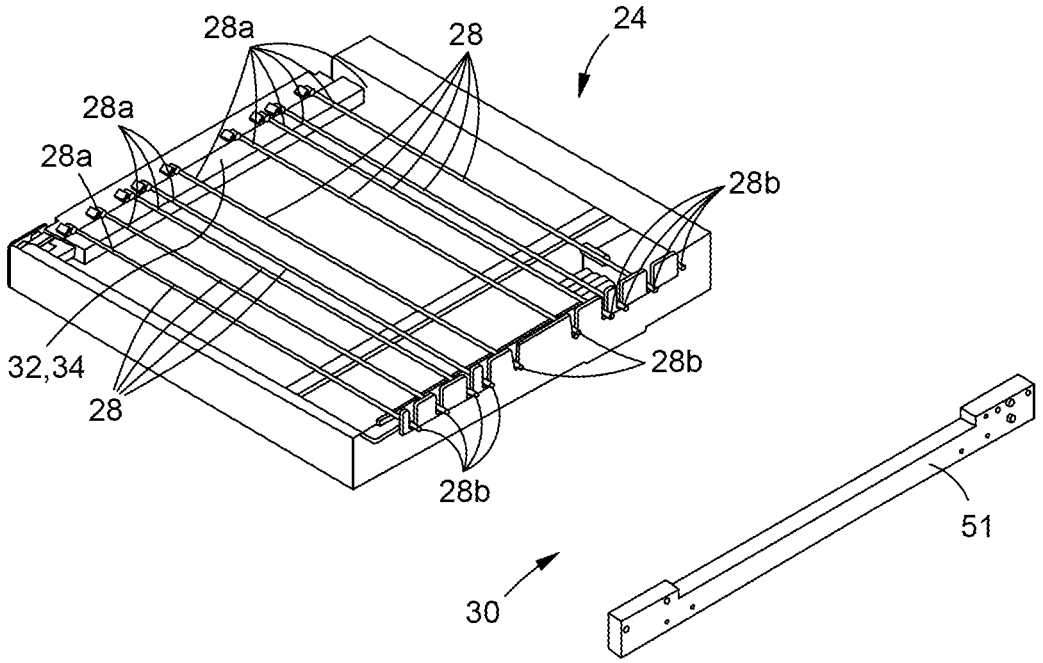
Figure 3:
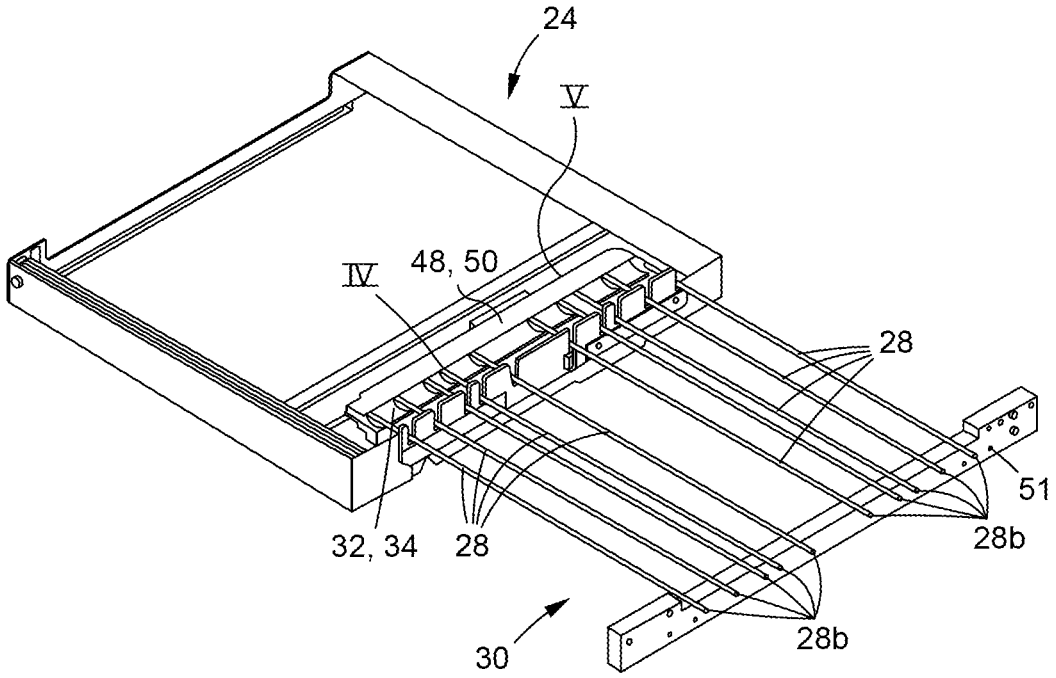
Figure 4:
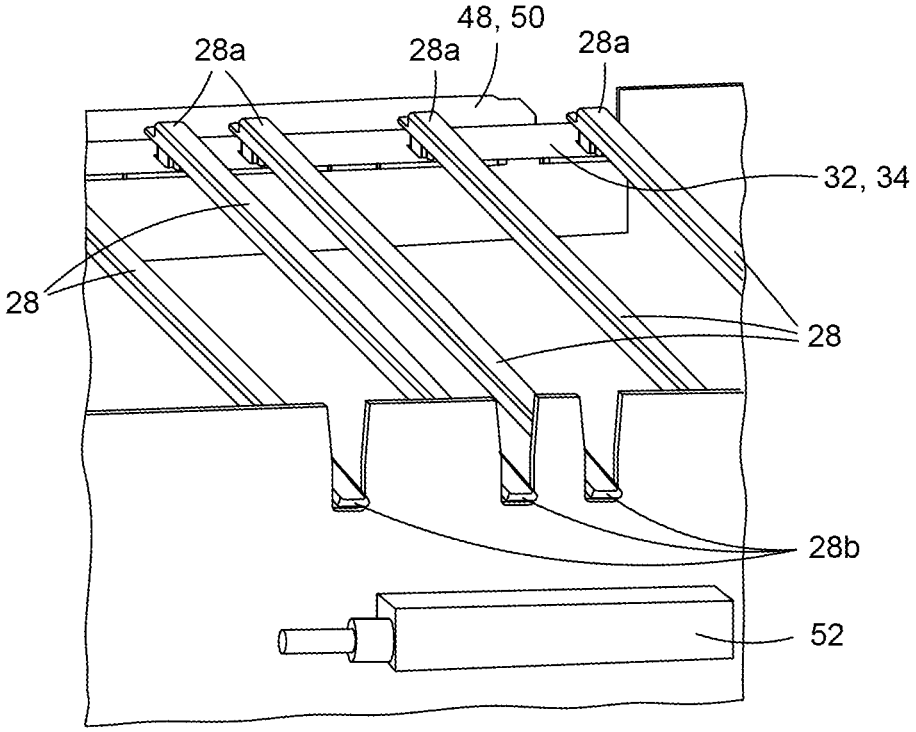
Figure 5:
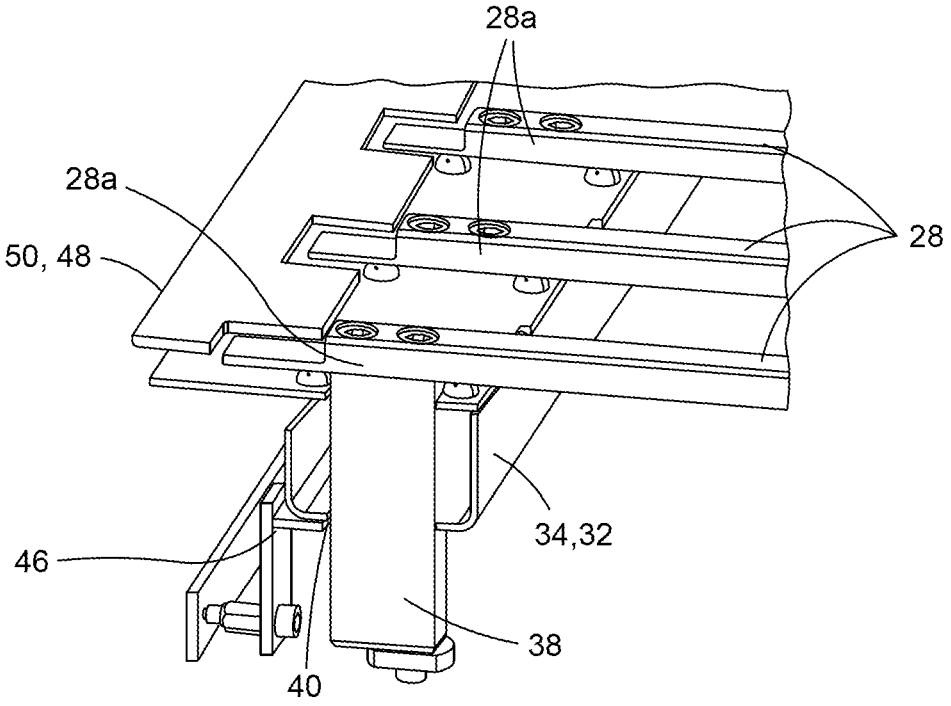
Figure 6:
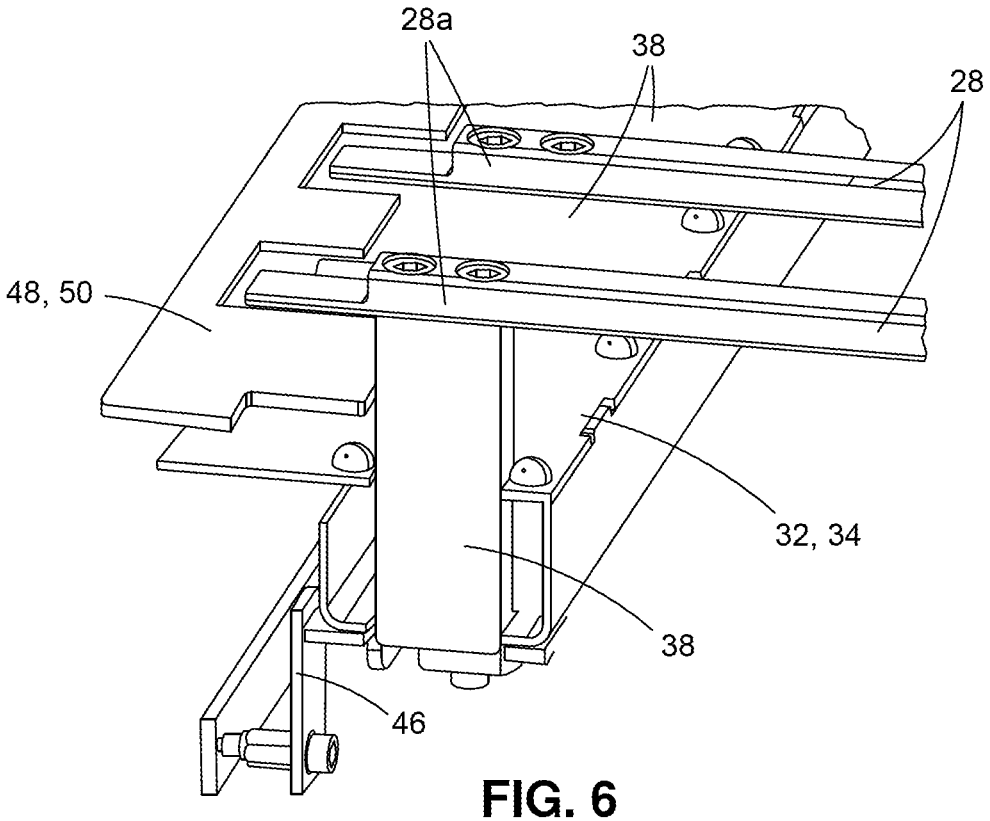
Figure 7:
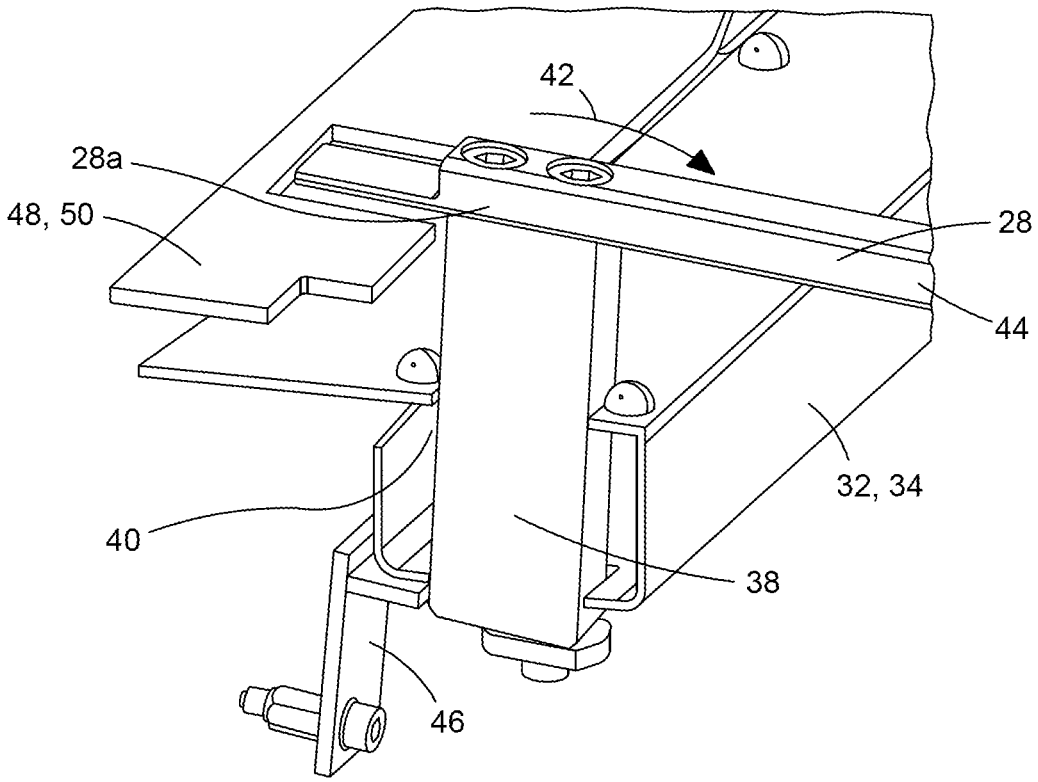
Figure 8:
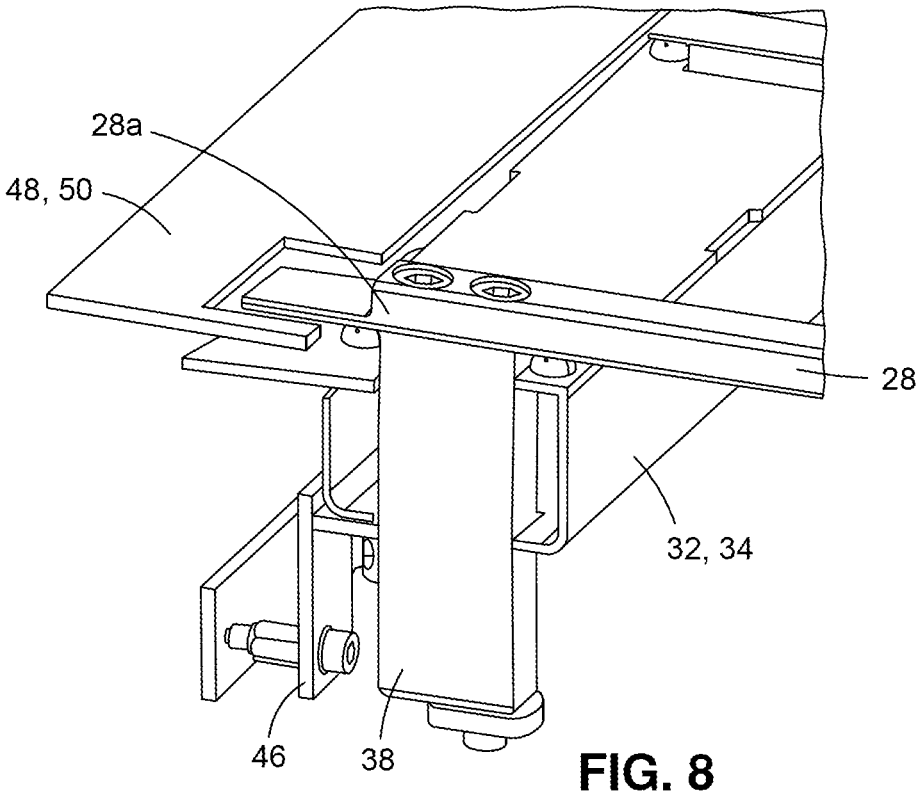
Figure 9:
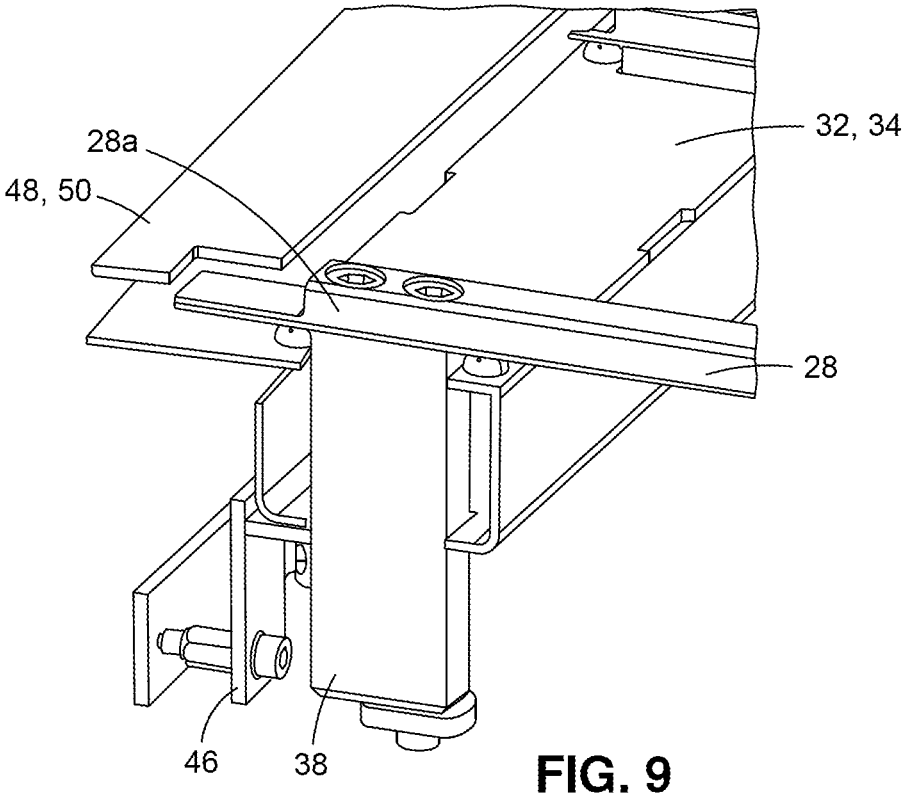
Figure 10:
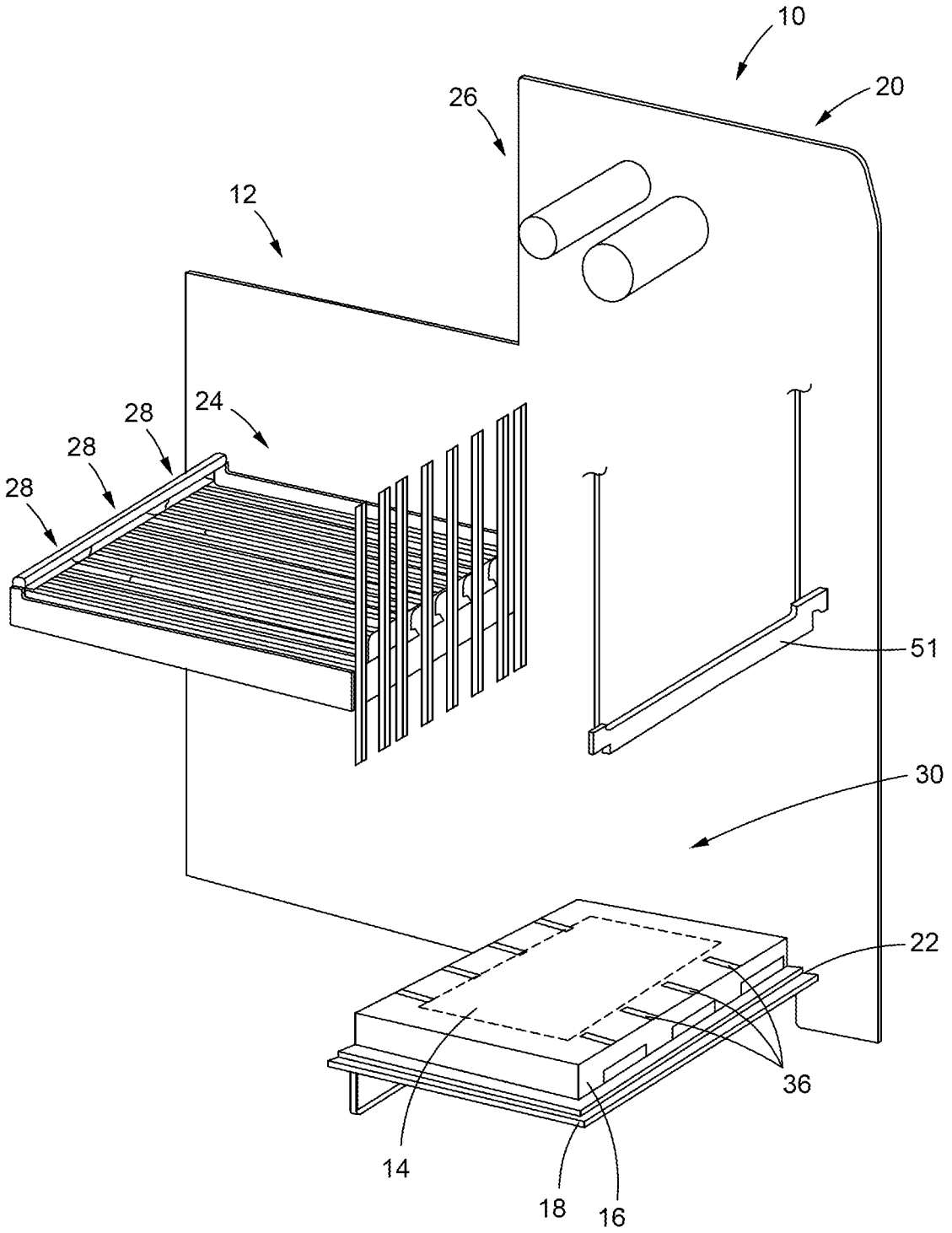
Figure 11:
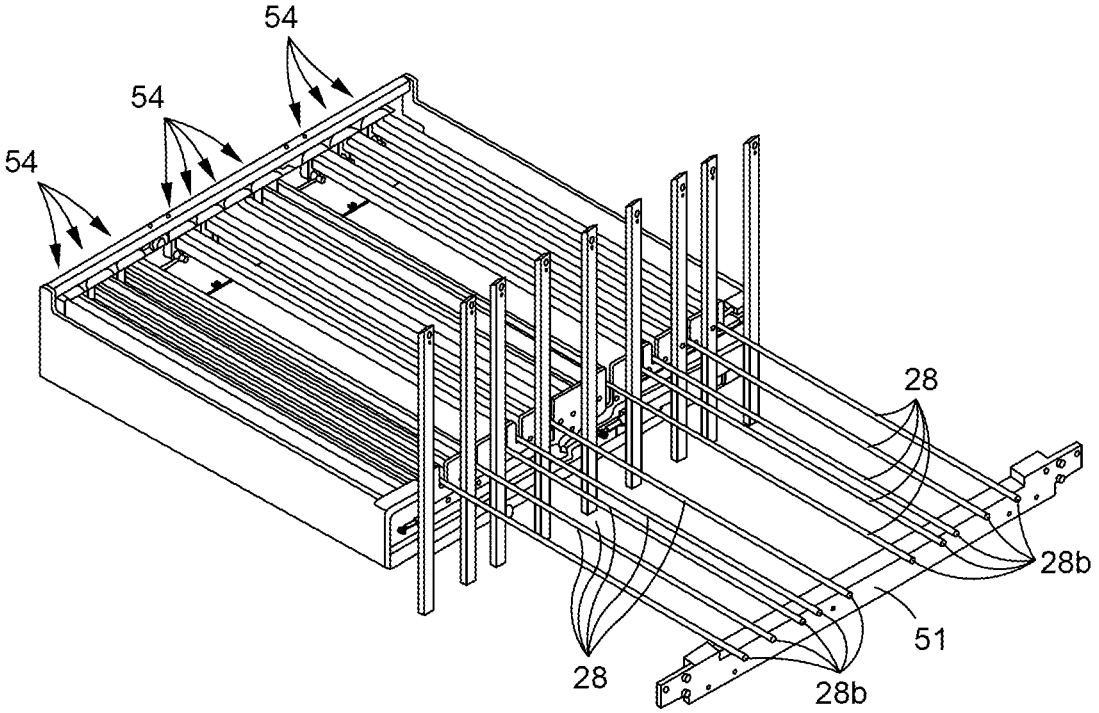
Figure 12:
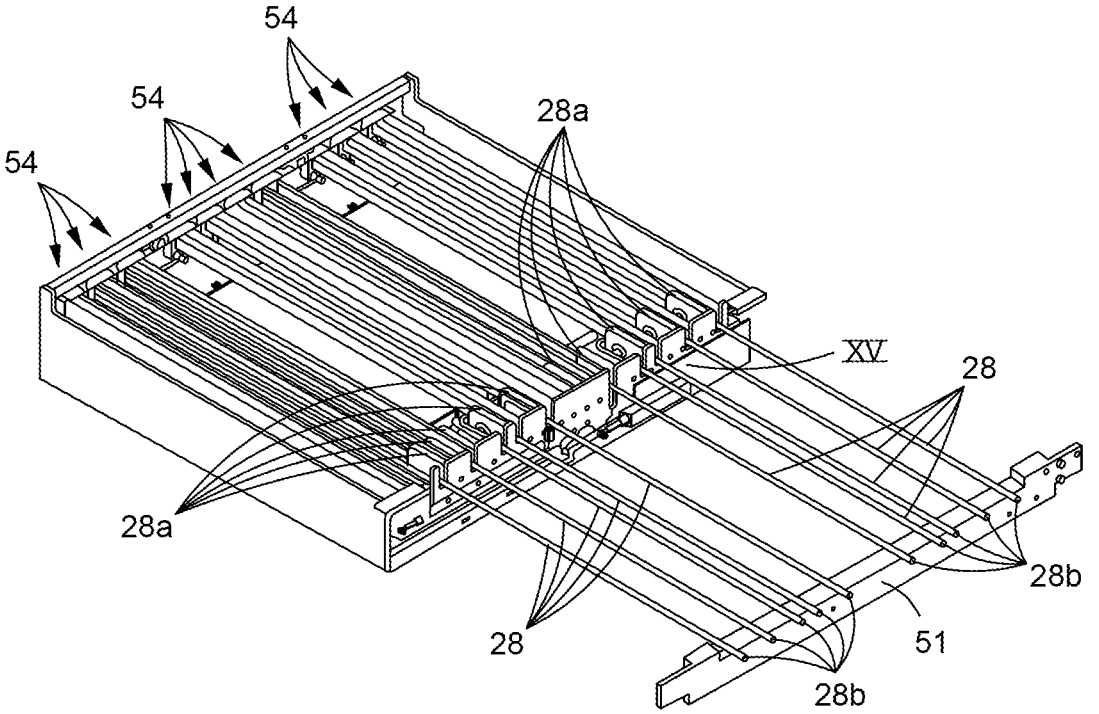
Figure 13:
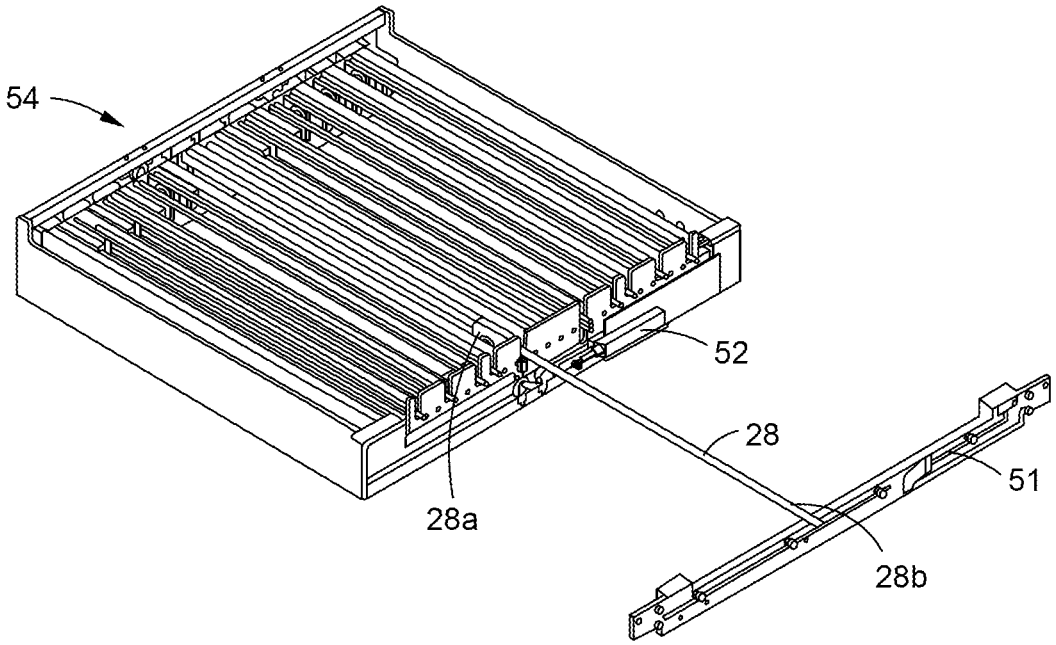
Figure 14:
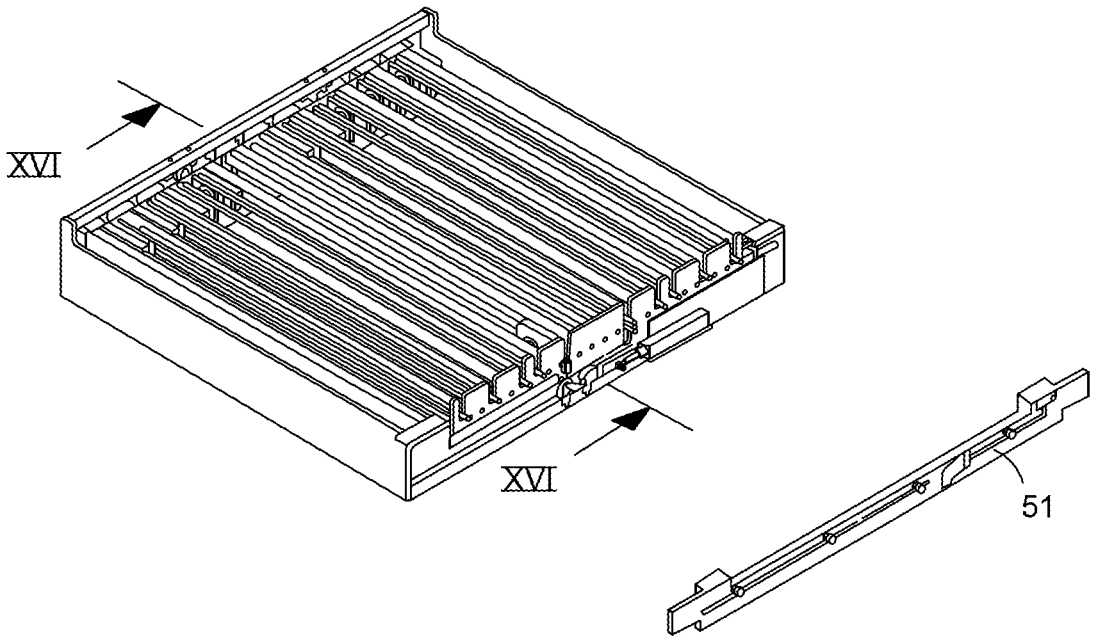
Figure 15:
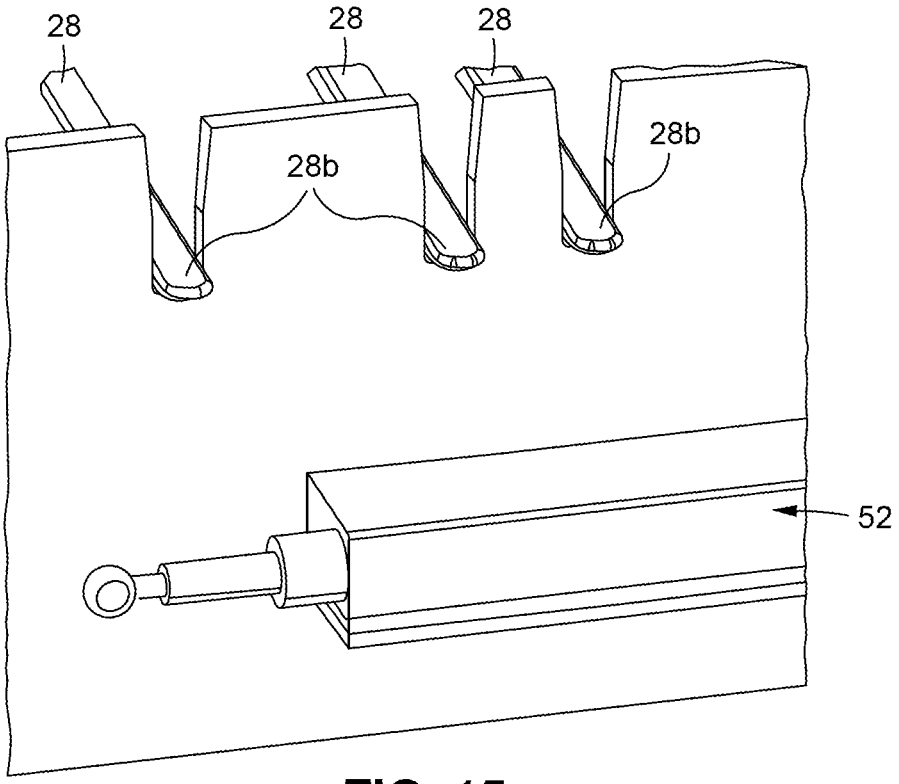
Figure 16:
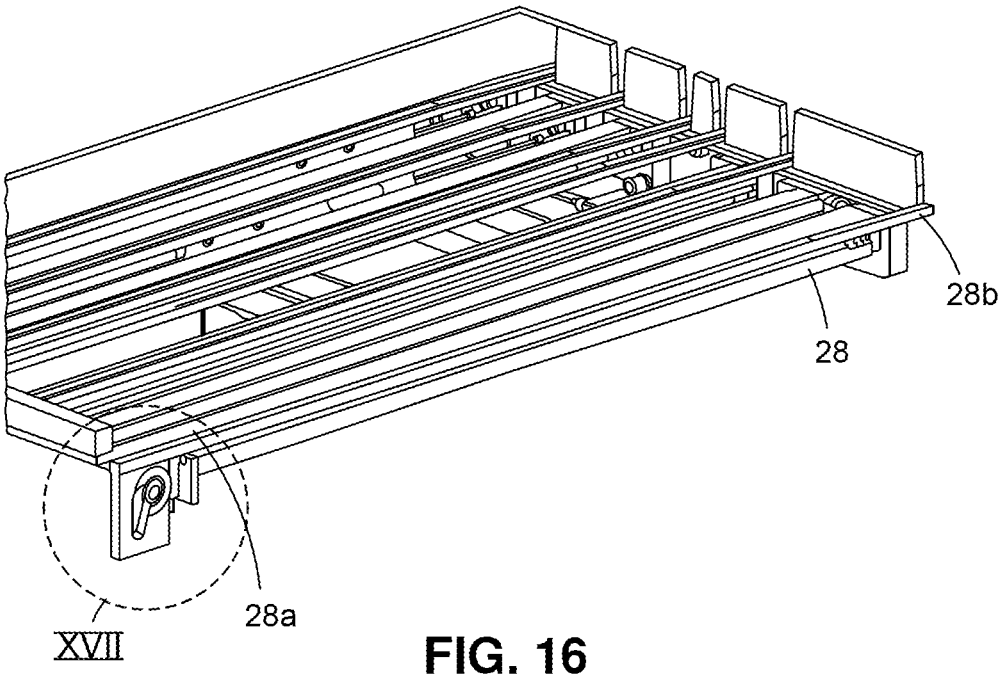
Figure 17:
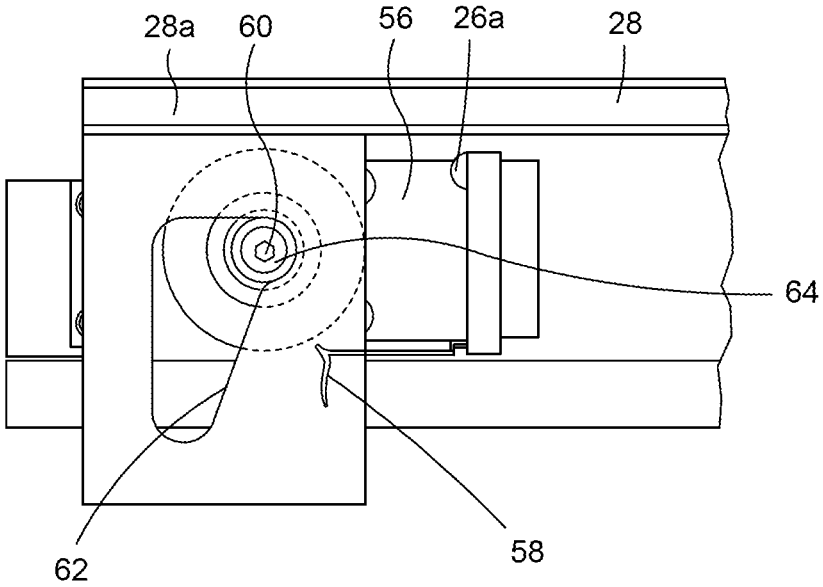
Figure 18:
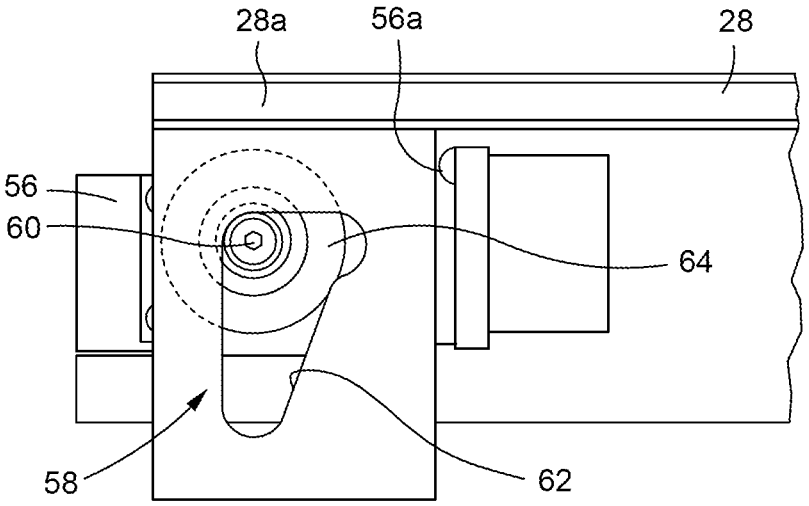
Figure 19:
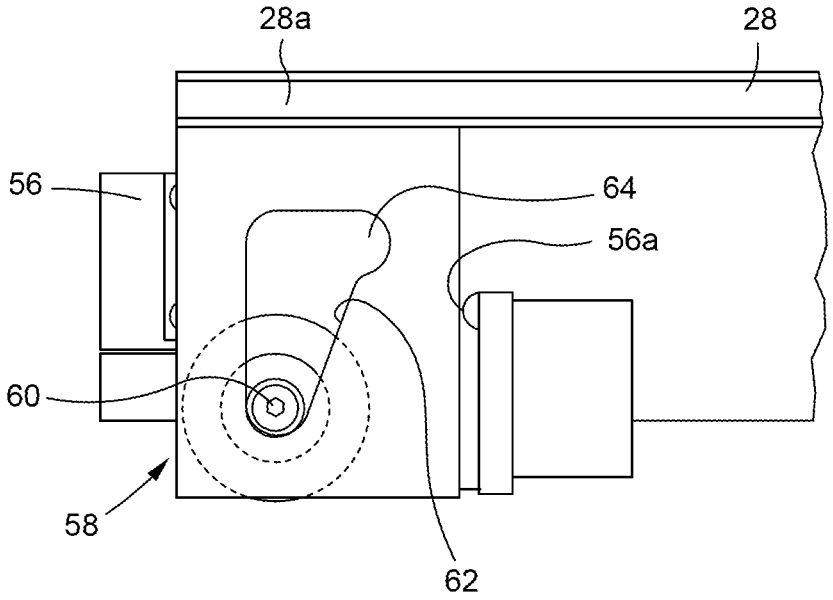
Figure 20:
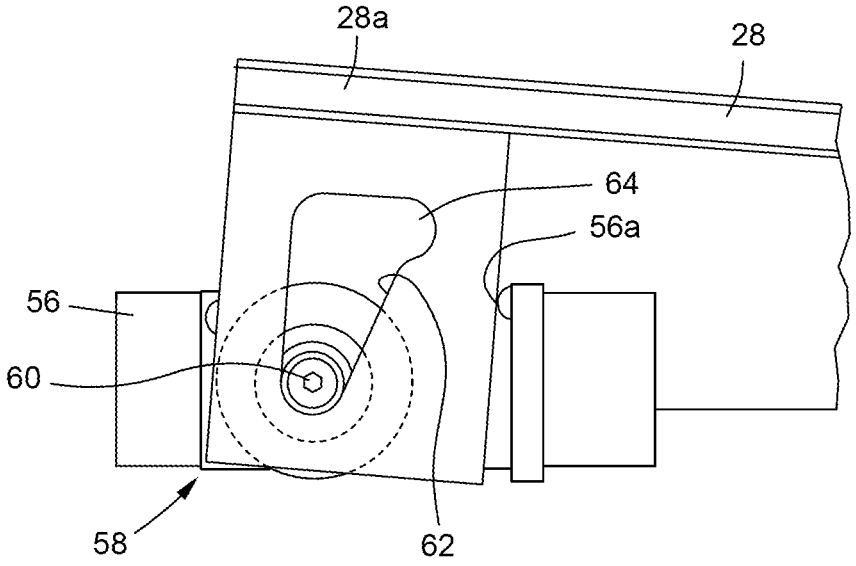
Figure 21:
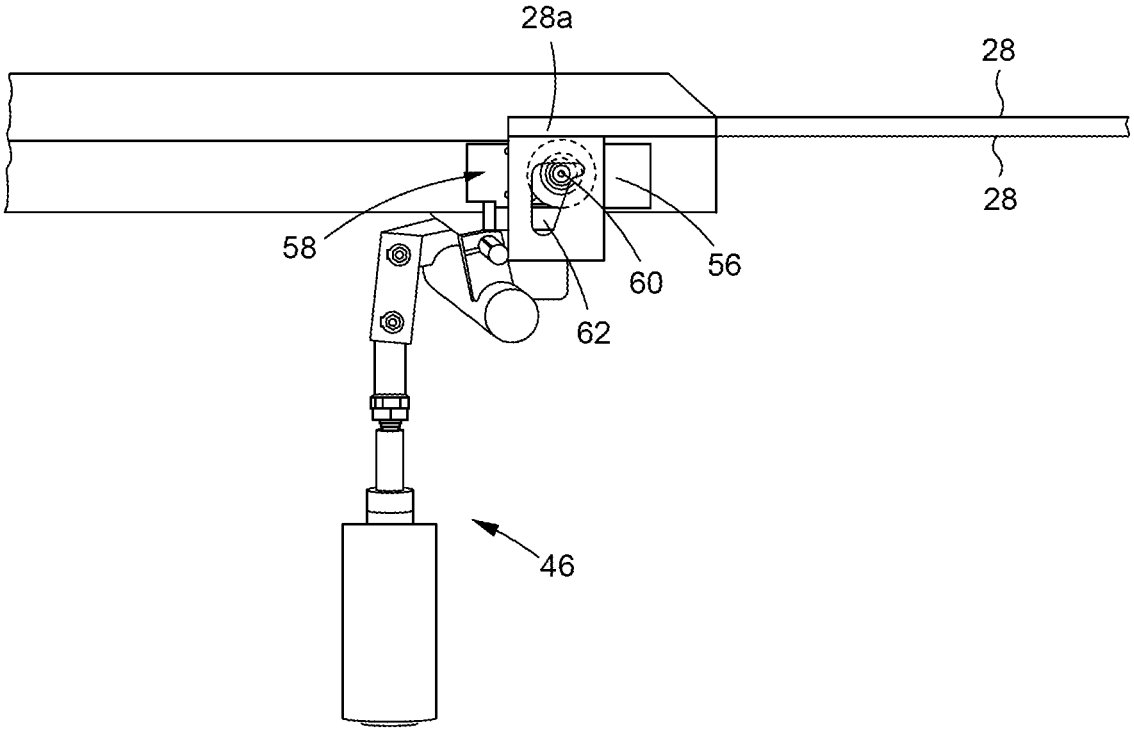

FIG. 1 shows a device for changing a sheet pile in a sheet feeder for a sheet treating machine according to a first embodiment of the invention, FIG. 2 shows a detail of FIG. 1, wherein the residual pile bars are outside the sheet pile region, FIG. 3 shows a detail of FIG. 1 corresponding to FIG. 2, wherein the residual pile bars are in the sheet pile region, FIG. 4 shows a detail IV of FIG. 3, FIG. 5 shows a detail V of FIG. 3, wherein the residual pile bars are in a lowest position, FIG. 6 shows detail V of FIG. 3, wherein the residual pile bars are in a highest position, FIG. 7 shows detail V of FIG. 3, wherein the residual pile bars are locked in the highest position, FIG. 8 shows detail V of FIG. 3, wherein the residual pile bars are locked in the lowest position, FIG. 9 shows detail V of FIG. 3, wherein the residual pile bars are about to be unlocked from the highest position, FIG. 10 shows a device for changing a sheet pile in a sheet feeder for a sheet treating machine according to a second embodiment of the invention, FIG. 11 shows a detail of FIG. 10, wherein the residual pile bars are in the sheet pile region, FIG. 12 shows the detail of FIG. 11, wherein an abutment for sheets is not shown, FIG. 13 shows the detail of FIGS. 11 and 12, wherein only one residual pile bar extends in the sheet pile region, FIG. 14 shows the detail of FIGS. 11 to 13, wherein the residual pile bars are outside the sheet pile region, FIG. 15 shows detail XV of FIG. 12, FIG. 16 shows section XVI-XVI of FIG. 14, FIG. 17 shows detail XVII of FIG. 16, wherein the residual pile bar is locked in the lowest position, FIG. 18 shows detail XVII of FIG. 16, wherein the residual pile bar is vertically movable and located in the lowest position, FIG. 19 shows detail XVII of FIG. 16, wherein the residual pile bar is vertically movable and located in the highest position, FIG. 20 shows detail XVII of FIG. 16, wherein the residual pile bar is located in the highest position and abuts against a slider carriage, and FIG. 21 shows detail XVII of FIG. 16, wherein the residual pile bar is about to be unlocked from the lowest position.

FIG. 1 shows a sheet feeder 10 comprising a device 12 for changing a sheet pile, wherein the sheet pile is represented by a single sheet 14 being placed on a pallet 16.

The pallet 16 is supported on a main pile supporting unit 18, which is coupled to a main pile actuating unit 20 for lifting and lowering the main pile supporting unit 18. More precisely, the pallet 16 is supported on a supporting surface 22 of the main pile supporting unit 18.

The device 12 further comprises a residual pile supporting unit 24, which is coupled to a residual pile actuating unit 26 for lifting and lowering the residual pile supporting unit 24.

As can best be seen from FIGS. 2 and 3, the residual pile supporting unit 24 comprises a plurality of residual pile bars 28. They extend substantially parallel to each other and also substantially parallel to the supporting surface 22.

The residual pile bars 28 are movable into a sheet pile region 30 (cf. FIG. 3) and can be retracted from the sheet pile region 30 (cf. FIGS. 1 and 2).

In order to allow for this movement, the residual pile bars 28 are coupled to a bar actuating unit 32, which comprises a first supporting bar 34. More precisely, respective first end sections 28*a* of the residual pile bars 28 are coupled to the first supporting bar 34.

The first supporting bar 34 is arranged substantially orthogonal to the residual pile bars 28 and in parallel to the supporting surface 22.

Thus, the residual pile bars 28 are arranged in the residual pile supporting unit 24 in a rake-like manner. Consequently, they can be positioned in respective slots 36 of the pallet 16 (cf. FIG. 1).

In the example shown, the first supporting bar 34 is made from sheet metal.

It is further noted that in FIG. 1 only a few slots 36 are represented in very a schematic way.

In principle, the number of slots 36 is independent from the number of residual pile bars 28.

In a preferred embodiment, the pallet 16 may be a standard pallet having the number of slots 36 usual for standard pallets.

The number of residual pile bars 28 is a choice when designing the sheet feeder 10. In the example shown ten residual pile bars 28 are used.

Usually, the number of residual pile bars 28 is inferior to the number of slots 36.

As can best be seen from FIGS. 5 to 9, each of the residual pile bars 28 comprises a guide rod 38 being connected to the first end section 28*a* of the respective residual pile bar 28.

Each of the guide rods 38 is guided inside a corresponding guide opening 40, which is provided on the first supporting bar 34.

Both the guide rod 38 and the guide opening 40 extend substantially orthogonal to the supporting surface 22, thus in a substantially vertical direction.

It can be seen for example from the comparison of FIGS. 5 and 6 that each of the residual pile bars 28 is movable within a predefined range of movement in a direction substantially orthogonal to the supporting surface 22, i.e. in a substantially vertical direction in the examples shown in the figures.

This movability is always to be understood as a movement relative to the residual pile supporting unit 24.

In FIG. 5 the residual pile bar assumes a lowest position and in FIG. 6 a highest position.

Such a movement can be performed independently by each of the residual pile bars. In other words: The vertical movements of the residual pile bars 28 with respect to the first supporting bar 34 are not coupled in any way.

The residual pile bar 28 can be locked in the highest position (cf. FIG. 7). In order to do so, it is slightly tilted with respect to the extension of the respective guide opening 40. Consequently, the guide rod 38 is canted inside the guide opening 40. The tilting movement is indicated by arrow 42 in FIG. 7.

In the example shown, the center of gravity 44 of an assembly comprising the residual pile bar 28 and the guide rod 38 attached thereto, is located within a certain distance of the guide opening 40.

As a result thereof, the tilting movement will occur, once the residual pile bar 28 is in the sheet pile region 30 and in the highest position.

In order to bring back the residual pile bar 28 to the movable state and from there to the lowest position, an unlocking means 46 is provided.

The unlocking means 46 is arranged below the first supporting bar 34 and is able to engage the guide rod 38 such that it is tilted back to extend substantially parallel to the extension of the guide opening 40. Subsequently, the residual pile bar 28 can be moved to the lowest position (cf. FIG. 5).

Also in this position the residual pile bar 28 can be locked. To this end, a locking unit 48 is provided, which comprises a locking profile 50.

The locking profile 50 can be in an unlocking position (cf. FIGS. 5, 6, 7 and 9) or in a locking position (cf. FIG. 8). In order to change positions, it is slidably supported on the first supporting bar 34, to which it extends substantially parallel. In the locking position, a portion of the locking profile 50 is arranged on top of the first end section 28*a* of the residual pile bar 28 such that the residual pile bar 28 cannot move out of the lowest position.

When the residual pile bars 28 are extended to the sheet pile region 30, respective second end sections 28*b* thereof can be supported on a second supporting bar 51, which extends generally parallel to the first supporting bar 34.

In order to position the residual pile bars 28 in a horizontal direction extending orthogonally to the general extension of the residual pile bars 28, a positioning unit 52 is provided (cf. FIG. 4). This positioning unit 52 mainly is used to align the residual pile bars 28 to the corresponding slots 36 of the pallet 16.

A sheet feeder 10 comprising a device 12 for changing a sheet pile according to a second embodiment is shown in FIGS. 10 to 21. In the following, only the differences between the second embodiment and the first embodiment will be explained in detail. Besides, reference is made to the above explanations.

Again, the sheet pile is represented by a single sheet 14. As can be seen from FIG. 11, a pile abutment 53 can be used in order to precisely position the sheet pile.

Furthermore, the pile abutment 53, especially its upper portion comprising vertical bars, is used to hold back the sheets when retracting the residual pile bars 28. As the sheets abut against the pile abutment 53, they do not move together with the residual pile bars 28 but stay substantially immobile.

In the device 12 according to the second embodiment mainly the bar actuating unit 32 and the corresponding coupling of the residual pile bars 28 thereto is different from the first embodiment (cf. FIGS. 11 to 14). The bar actuating unit 32 now comprises a plurality of bar actuating units 54, wherein each of the residual pile bars 28 is coupled to one single residual pile bar actuating unit 54. For this reason, each of the residual pile bars 28 can be moved to the sheet pile region 30 independently from the other residual pile bars 28. The same is true for the retraction of the residual pile bars 28 from the sheet pile region 30.

Each of the residual pile bar actuating units 54 comprises a slider carriage 56.

The corresponding residual pile bar 28 is coupled to the slider carriage via a cam mechanism 58.

In the example shown, the cam mechanism 58 comprises a pin 60, which is attached to the slider carriage 56 and a cam opening 62, which is connected to the residual pile bar 28. The pin 60 is received in the cam opening 62.

The cam opening 62 has a generally triangular form, wherein one side of the triangle extends substantially parallel to the corresponding residual pile bar 28.

The corners of the triangle are furthermore arranged such that in a region remote from the respective second end section 28*b* of the corresponding residual pile bar 28 the pin 60 can move in a substantially vertical direction inside the cam opening 62.

In the corner arranged next to the respective second end section 28*b* of the corresponding residual pile bar, a locking recess 64 is arranged.

When the pin 60 is arranged in the locking recess 64, a vertical movement of the corresponding residual pile bar is blocked. Consequently, the locking recess 64 is part of the locking unit 48 being able to lock the residual pile bar in the lowest position.

The pin 60 can be moved out of the locking recess 64 by unlocking means 46, which creates a relative movement between the residual pile bar 28 and the slider carriage 56 by slightly pushing the residual pile bar 28 in the direction of the sheet pile region 30 (cf. FIG. 21).

Since the cam mechanism 58 as such only defines a pivot connection between the slider carriage 56 and the residual pile bar 28, an abutment 56*a* is provided on the slider carriage 56, which blocks a rotational relative movement of the residual pile bar 28 with respect to the slider carriage. This can especially be seen in FIG. 20.

In the following, the operation of the sheet feeder 10 with a device for changing a sheet pile according to the first and the second embodiment is explained.

During the operation of the sheet feeder 10, a remaining height of the sheet pile, represented by the single sheet 14, is monitored. As explained above, the sheet pile is positioned on the pallet 16 being arranged on the supporting surface 22 of the main pile supporting unit 18.

Once a predefined limit height of the sheet pile is detected, it is concluded that a replacement sheet pile needs to be provided in the sheet feeder 10.

To this end, the sheet pile currently being processed, which will be referred to as a residual sheet pile, is supported by the residual pile supporting unit 24 in that the residual pile bars 28 are moved into respective slots 36 of the pallet 16. Thereby, the residual pile bars 28 are brought to the sheet pile region 30.

The residual pile bars 28 are locked in the lowest position while being moved into the sheet pile region 30.

The movement is powered by the first supporting bar 34 (first embodiment) or the residual pile bar actuating units 54 (second embodiment).

Once the residual sheet pile is fully supported on the residual pile bars 28, the pallet 16 can be withdrawn by lowering the main pile supporting unit 18. Subsequently, a replacement pallet 16 carrying a replacement sheet pile is placed on the main pile supporting unit 18.

After that, the main pile supporting unit 18 is raised until an upper end of the replacement sheet pile gets in contact with the residual pile bars 28. This contact may be detected by a specific sensor being able to detect the small raise of the residual pile bars 28 when making contact with the replacement sheet pile.

In a preferred embodiment, one sensor is employed at the front end of the residual pile bars 28. This sensor is adapted to detect movements of the front ends or tips of the residual pile bars 28.

Another sensor is employed at the rear end of the residual pile bars. This sensor is adapted to detect movements of the rear ends thereof.

In an alternative solution, each of the residual pile bars 28 is equipped with two sensors, one at the respective front end and one at the respective back end.

The overall aim is to detect the first of the residual pile bars 28, which is moving after having made contact with the replacement sheet pile.

Then, the residual pile bars are engaged between a lower end of the sheet pile and an upper end of the replacement sheet pile.

Just before the replacement sheet pile gets in contact with the residual pile bars 28, they are unlocked while still remaining in the lowest position.

To this end, the locking profile 50 is moved to the unlocking position in the first embodiment.

In the second embodiment, the residual pile bar 28 is slightly moved towards the sheet pile region 30 by the unlocking means 46. Thereby, it moves relative to the slider carriages 56 such that the pin 60 moves out of the locking recess 64.

Now the residual pile bars 28 are movable within a predefined range of movement in a direction substantially orthogonal to the supporting surface 22. Consequently, they can adapt their vertical position to the geometry of the top of the replacement sheet pile and to the bottom of the residual sheet pile.

Afterwards, the residual pile bars 28 are retracted from the sheet pile region 30 such that the residual sheet pile is supported on the replacement sheet pile.

While being retracted, the residual pile bars 28 are still movable within the predefined range of movement.

In the first embodiment, all residual pile bars 28 are retracted together, wherein in the second embodiment die residual pile bars 28 are retracted independently from each other, for example following a predefined pattern.

When the residual pile bars 28 are fully retracted from the sheet pile region 30, they are moved to the lowest position.

The sheet feeders 10 shown in the figures may be used in combination with any type of sheet treating machine (not represented), e. g. a sheet cutting machine or a sheet printing machine.

The invention claimed is:

1. A device for changing a sheet pile in a sheet feeder for a sheet treating machine, the device comprising:

a main pile supporting unit comprising a supporting surface adapted to support a pallet carrying a sheet pile; and a residual pile supporting unit comprising a plurality of residual pile bars extending substantially parallel to each other and being substantially parallel to the supporting surface, the plurality of residual pile bars are coupled to a bar actuating unit adapted to move the plurality of residual pile bars into a sheet pile region and retract the plurality of residual pile bars from the sheet pile region, the plurality of residual pile bars are arranged in the residual pile supporting unit-such that the plurality of residual pile bars are positionable in respective slots of the pallet being supported on the main pile supporting unit when the plurality of residual pile bars are in the sheet pile region, each of the plurality of residual pile bars are movable within a predefined range of movement in a direction substantially orthogonal to the supporting surface, and the plurality of residual pile bars are movable independently from each other.

2. The device of claim 1, wherein each of the plurality of residual pile bars has a lowest position and a highest position, and the device further includes a locking unit adapted to lock all of the plurality of residual pile bars in respective lowest positions.

3. The device of claim 2, wherein the locking unit comprises a locking profile movable into a locking position and an unlocking position, the bar actuating unit comprises a first supporting bar extending in a substantially orthogonal direction with respect to the plurality of residual pile bars and being substantially parallel to the supporting surface, respective first end sections of each of the plurality of residual pile bars are coupled to the first supporting bar, and the locking profile is slidably supported on the first supporting bar and extends substantially parallel to the first supporting bar.

4. The device of claim 1, wherein the bar actuating unit comprises a first supporting bar extending in a substantially orthogonal direction with respect to the plurality of residual pile bars and being substantially parallel to the supporting surface, and respective first end sections of each of the plurality of residual pile bars are coupled to the first supporting bar.

5. The device of claim 4, wherein each of the plurality of residual pile bars comprises a guide rod being connected to a respective first end section, each guide rod of the plurality of residual pile bars is guided inside a corresponding guide opening, each guide opening is arranged on the first supporting bar, and each guide rod and each guide opening extend substantially orthogonal to the supporting surface.

6. The device of claim 5, wherein each guide rod is tilted with respect to a respective guide opening, when a corresponding residual pile bar of the plurality of residual pile bars is in a highest position and in the sheet pile region, such that each guide rod is canted inside the respective guide opening.

7. The device of claim 6, further including an unlocking means being adapted to bring one or more of guide rod into a non-tilted position with respect to the respective guide opening or guide openings.

8. The device of claim 1, wherein the bar actuating unit comprises a plurality of residual pile bar actuating units, and each of the plurality of residual pile bars are coupled to one single residual pile bar actuating unit such that the plurality of residual pile bars are adapted to being moved into a sheet pile region independently from each other and/or being retracted from the sheet pile region independently from each other.

9. The device of claim 8, wherein each of the plurality of residual pile bar actuating units comprises a slider carriage, and each of the plurality of residual pile bars are coupled to a corresponding slider carriage.

10. The device of claim 9, wherein each slider carriage is coupled to a residual pile bar via a cam mechanism.

11. The device of claim 10, wherein each of the plurality of residual pile bars has a lowest position and a highest position, and the device further includes a locking unit adapted to lock all of the plurality of residual pile bars in respective lowest positions, the locking unit includes a locking recess as a part of each cam mechanism.

12. The device of claim 1, wherein end sections of the plurality of residual pile bars facing away from the bar actuating unit are supported on a supporting bar, when the plurality of residual pile bars are in the sheet pile region.

13. A method for changing a sheet pile in a sheet feeder for a sheet treating machine, the method comprising:

detecting a limit height of a sheet pile being processed in the sheet feeder, wherein the sheet pile is supported on a pallet being arranged on a main pile supporting unit, supporting the sheet pile by a residual pile supporting unit by pushing a plurality of residual pile bars into respective slots of the pallet, withdrawing the pallet on the main pile supporting unit from the sheet pile and placing a replacement pallet carrying a replacement sheet pile on the main pile supporting unit, bringing an upper end of the replacement sheet pile in contact with the plurality of residual pile bars such that the plurality of residual pile bars are engaged between a lower end of the sheet pile and the upper end of the replacement sheet pile, and retracting the plurality of residual pile bars from a sheet pile region such that the sheet pile is supported on the replacement sheet pile, wherein the plurality of residual pile bars are freely movable in a direction orthogonal to a pallet surface while being retracted.

14. The method of claim 13, wherein, during supporting the sheet pile, withdrawing the pallet, and placing the replacement pallet, all of the plurality of residual pile bars are locked in a lowest position.

15. The method of claim 13, wherein, during or after bringing the upper end of the replacement sheet pile in contact with the plurality of residual pile bars, the plurality of residual pile bars are unlocked, and during bringing the upper end of the replacement sheet pile in contact with the plurality of residual pile bars and/or retracting the plurality of residual pile bars, one or more of the plurality of residual pile bars are moved out of a lowest position.

16. The method of claim 13, wherein, during bringing the upper end of the replacement sheet pile in contact with the plurality of residual pile bars, a contact between the upper end of the replacement sheet pile and each of the plurality of residual pile bars is individually detected for each of the plurality of residual pile bars.

17. The method of claim 13, wherein during retracting the plurality of residual pile bars, the plurality of residual pile bars are retracted independently from each other.

18. The method of claim 13, wherein, after retracting the plurality of residual pile bars, all of the plurality of residual pile bars are moved to their respective lowest position.

19. A device for changing a sheet pile in a sheet feeder for a sheet treating machine, the device comprising:

a residual pile supporting unit comprising a plurality of residual pile bars extending substantially parallel to each other and being substantially parallel to a supporting surface, the plurality of residual pile bars being coupled to a bar actuating unit adapted to move the plurality of residual pile bars into a sheet pile region and retract the plurality of residual pile bars from the sheet pile region, the plurality of residual pile bars being arranged in the residual pile supporting unit such that the plurality of residual pile bars are positionable in respective slots of a pallet being supported when the plurality of residual pile bars are in the sheet pile region, each of the plurality of residual pile bars are movable within a predefined range of movement in a direction substantially orthogonal to the supporting surface, and the plurality of residual pile bars are movable independently from each other.

20. The device of claim 19, wherein each of the plurality of residual pile bars has a lowest position and a highest position, and the device further includes a locking unit adapted to lock all of the plurality of residual pile bars in respective lowest positions.

* * * * *